US005441192A

United States Patent [19]

Sugita et al.

[11] Patent Number: 5,441,192

[45] Date of Patent: Aug. 15, 1995

[54] FASTENER DRIVING TOOL

[75] Inventors: Saburo Sugita; Hiroyuki Fukui; Yukinori Komiya, all of Tokyo, Japan

[73] Assignee: Kanematsu-nnk Corporation, Tokyo, Japan

[21] Appl. No.: 352,829

[22] Filed: Dec. 2, 1994

[30] Foreign Application Priority Data

Dec. 3, 1993 [JP] Japan ..... 5-304247

[51] Int. Cl.[6] ..... B25C 1/04

[52] U.S. Cl. ..... 227/130; 173/211; 173/212

[58] Field of Search ..... 227/130, 120, 8; 173/210, 211, 212

[56] References Cited

U.S. PATENT DOCUMENTS

| | | | |
|---|---|---|---|
| 3,901,130 | 8/1975 | Lange | 227/130 |
| 4,320,864 | 3/1982 | Novak et al. | 227/130 |
| 4,401,251 | 8/1983 | Nikolich | 227/130 |
| 5,020,712 | 6/1991 | Monacelli | 227/130 |
| 5,131,579 | 7/1992 | Okushima et al. | 227/130 |

FOREIGN PATENT DOCUMENTS 4-53908 12/1992 Japan .

*Primary Examiner*—Scott A. Smith

*Attorney, Agent, or Firm*—Willian Brinks Hofer Gilson & Lione

[57] ABSTRACT

A fastener driving tool prevents the tool from twice striking, so-called double-driving in a single driving operation. A portion closing the lower end of a cylinder of the tool is formed with an annular recess to receive a ring-bumper as a shock absorber of a piston. The recess has a sufficient depth to move a lower portion of the bumper downward and upward. The bumper is fittingly pressed into the recess to form an air chamber in the recess closed by the lower end of the bumper. A check valve is positioned between the air chamber and a supply of the pressurized air to feed the pressurized air to the air chamber so that the pressurized air is further compressed by the bumper which is downwardly moved by the abrupt downward movement of the piston. Thus, greater reaction force is applied from the air chamber to the lower portion of the bumper so as to prevent a driver of the tool from the double-driving.

10 Claims, 4 Drawing Sheets

FASTENER DRIVING TOOL

FIELD OF THE INVENTION

The present invention relates to a tool for driving a fastener, such as a nail and more particularly to a fastener driving tool to absorb shock or impact caused by abrupt downward movement of a piston to improve the durability of a bumper and to prevent the tool from double-driving in a single driving operation.

BACKGROUND OF THE INVENTION

There is a well known fastener driving tool having a housing in which pressurized air is supplied and a cylinder is located. A piston is reciprocatingly received within the cylinder. The piston has a driving rod as a driver to drive a fastener onto an object. The pressurized air in the housing is fed to the upper portion of the cylinder, so that the piston abruptly moves downwardly. Thus, the driver drives a fastener placed in a nose of the tool onto the object. A return-air-chamber is formed between the outer surface of the cylinder and the inner wall of the housing to store compressed air therein. Then, the pressurized air is exhausted from the upper portion of the cylinder to the atmosphere. The compressed air in the return-air-chamber is fed to the lower surface of the piston to return the piston to the upper position of the cylinder. A bumper is disposed on the lower end of the cylinder to absorb shock or impact caused by the abrupt down-movement of the piston. Such a fastener driving tool is described in, for example, Japanese U.M. Publication No. 4-53908.

In the driving tool described in the above publication, an improved return-air-chamber is formed to overcome a problem that the piston sometimes fails to return to the upper dead point if the capacity of the return-air-chamber is small. In the driving tool of the prior art, an additional air chamber 9 is formed below the bumper 11 to receive the pressurized air from the return-air-chamber 7 to increase the capacity of the return-air-chamber. A cavity 13 is formed in the lower potion of the bumper 11 to collect pressurized air from the additional air chamber 9 to increase a shock absorbing force of the bumper and to reduce heat generation in the bumper as well as prevention of improper return of the piston. Nevertheless, this known driving tool has another problem to be overcome. In a driving operation, the piston strikes and compresses the bumper. The compressed bumper reacts to press the piston upwardly. On the other hand, high air pressure is continued to be applied to the upper surface of the piston. Thus, both the piston and the driver are forced to again be pressed down. That is, so-called double-driving or twice-driving occurs. The double-driving is undesirable. At the first driving stage, the driver properly strikes a fastener such as a nail to be driven into an object. At the second driving stage in the double-driving, however, the driver hits not only the fastener but the object such as a decorative panel to damage the hit area of the object.

SUMMARY OF THE INVENTION

Accordingly, an object of the present invention is to provide a fastener driving tool to suppress vibrations and impact noise of the driving tool.

Another object of the present invention is to provide a fastener driving tool to prevent the tool from double-driving in a single driving operation of the tool.

A further object of the present invention is to provide a fastener driving tool to more effectively suppress vibration and impact noise of the driving tool when the piston strikes the bumper.

Still further object of the present invention is to provide a fastener driving tool to more effectively suppress vibration and impact noise of the driving tool so that higher strength material can be used for a bumper to enhance the durability of the bumper.

In accordance with the present invention, there is provided a fastener driving tool comprising a housing, a cylinder disposed within the housing, a piston reciprocatingly located within the cylinder, a driver connected with the piston, a nose extending downward of the cylinder, a return-air-chamber formed between the cylinder and the housing to store compressed air and a ring bumper to absorb shock of the piston wherein the pressurized air is fed from the upper portion of the cylinder to the upper surface of the piston to abruptly move the piston downward to cause the driver to strike the fastener in the nose to an object, the bumper functions to absorb the shock according to the abrupt downward movement of the piston. The fastener driving tool further comprises: a first annular recess formed in a portion closing the lower end of the cylinder to receive the ring bumper with the recess having a sufficient depth to move a lower portion of the bumper downward and upward; the first annular recess formed so that the bumper is fittingly pressed into the recess to form an air chamber as defined in the recess closed by the lower end of the bumper; and a check valve positioned between the air chamber and a supply of the pressurized air to feed the pressurized air to the air chamber so that the pressurized air is further compressed by the bumper which is downwardly moved by the abrupt downward movement of the piston.

Further, the fastener driving tool in accordance with another aspect of the present invention further comprises: an annularly projecting upper portion formed on the bumper projecting toward the lower surface of the piston; and a second annular recess formed on the lower surface of the piston to receive the projecting upper portion of the bumper whereby the projecting upper portion of the bumper is fittingly pressed into the second recess to compress the air confined by the second recess which is closed by the projecting upper portion of the bumper.

DETAILED DESCRIPTION OF THE PREFERRED EMBODIMENTS

Figure 1:
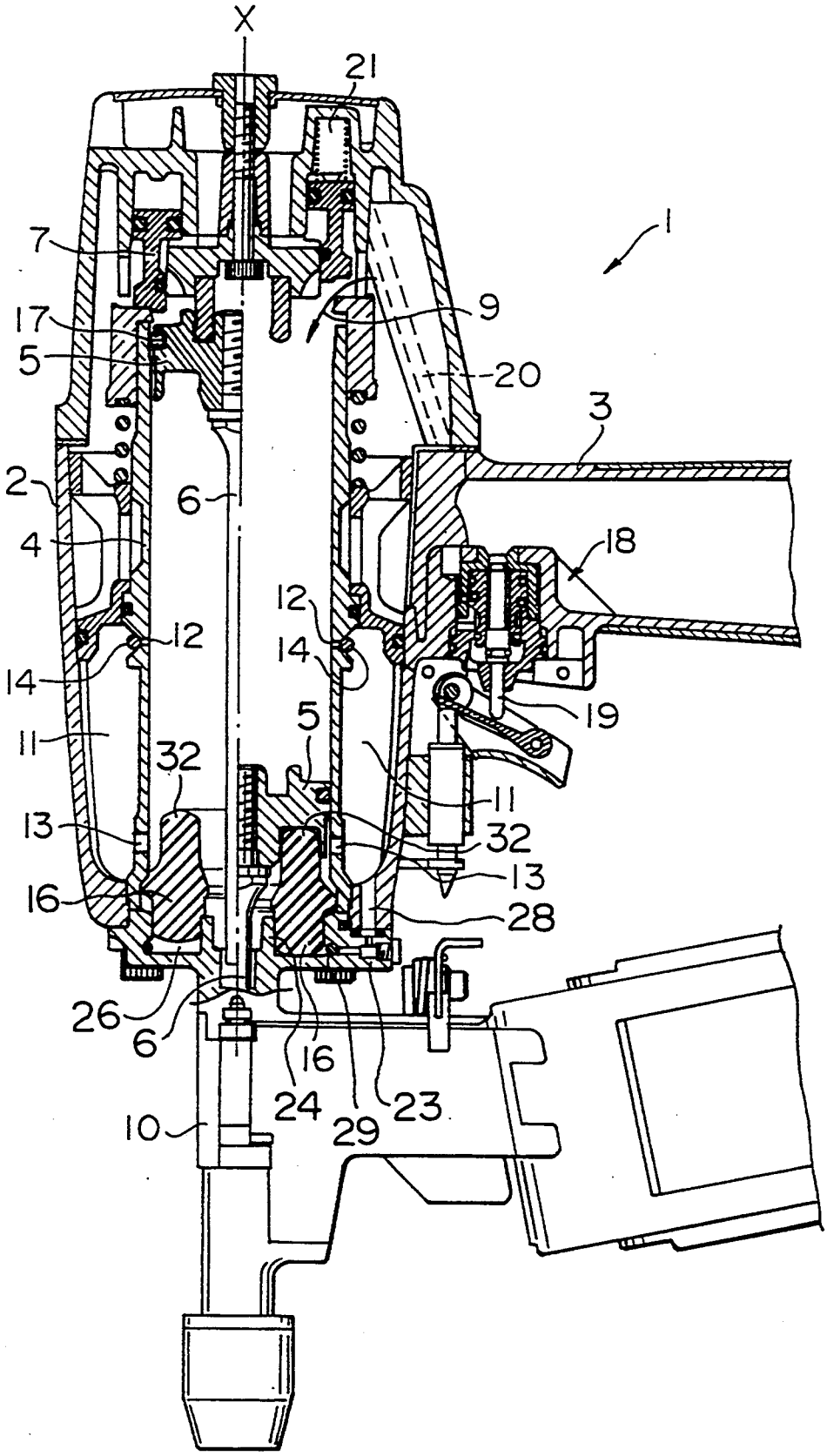
FIG. 1 is a partially broken front view of a fastener driving tool according to the present invention showing a principal portion of the tool by conveniently broken, in which at left half of a cylinder from an axis line x, a piston is in a static mode position and at right half of the cylinder from the axis x, the piston is in a driving mode position.

FIG. 1 shows a fastener driving tool 1, for example, a nail driving tool. The tool 1 comprises a housing 2 having a handle 3 molded with the housing 2 in which pressurized air is supplied from an inlet (not shown) at the end of the handle 3 in which a reservoir is formed for the pressurized air. A cylinder 4 is fixed in the housing 2 and a piston 5 is reciprocatingly located in the cylinder 4. The piston 5 has a driver 6 to drive a fastener to an object. A main valve 7 is positioned on the upper end of the cylinder 4. The main valve is moved between a static mode position, as shown in left half from the axis x, where the valve seals the upper end of the cylinder 4 to prevent the pressurized air from flowing from the housing 2 into the cylinder and a driving mode position, as shown in right half from the axis x, where the sealing of the upper end of the cylinder 4 is released to feed the pressurized air from the housing 2 to the cylinder. In the static mode, the piston 5 stands at an upper position of the cylinder 4. In the driving mode, the pressurized air is supplied toward the upper surface of the piston 5 through a space between the main valve 7 and the upper end of the cylinder 4 as shown by an arrow 9 so that the piston 5 is pressed down strongly and abruptly.

When the piston is thus pressed down, the driver 6 drives or strikes a fastener placed in a nose 10 to drive it into an object, such as a decorative panel. Simultaneously with this driving, pressurized air is supplied from the cylinder 4 to a return-air-chamber 11 formed between the outer surface of the lower portion of the cylinder 4 and the inner wall of the housing 2 through holes of the cylinder. Until the piston 5 reaches mid holes 12 of the cylinder, only pressurized air on the lower side of the piston 5 is fed to the return-air-chamber 11 through the mid holes 12 and lower holes 13 of the cylinder 4. When the piston 5 passes through the mid holes 12, not only the air below the piston 5 is supplied through the lower holes 13 but also the pressurized air in the cylinder above the piston is supplied through the mid holes 12. Since an O-ring 14 as a check valve is attached to the mid holes 12, the air in the chamber 11 does not flow from the mid holes reversely to the cylinder so that a sufficient amount of pressurized air is collected in the return-air-chamber 11. Accordingly, upon returning the main valve 7 to the static position (the position in left half from the axis x), the pressurized air in the return-air-chamber 11 flows through the lower holes 13 onto the lower surface of the piston 5 in the cylinder chamber so that the piston 5 is returned to the static mode or home position at the upper position of the cylinder 4 while exhausting air above the piston 5 in the cylinder to an atmosphere. A bumper 16 of rubber or other shock absorbing material is positioned at the lower end of the cylinder to absorb shock or impact caused by abrupt downward movement of the piston 5. An O-ring 17 is mounted on the periphery of the piston 5 to make a seal to the cylinder 4.

The main valve 7 is controlled by means of a trigger assembly 18 in the handle 3. When a trigger valve pin 19 is not pressed to stand in its static mode position, the pressurized air is fed to a main valve chamber 21 through the trigger assembly 18 and further through a pipe 20 as indicated by dotted lines in FIG. 1, so that the main valve 7 is pressed downwardly to stay in the static mode position as shown in the left half from the axis x in FIG. 1. When the trigger valve pin 19 is pressed upwardly, the pressurized air is exhausted from the main valve chamber 21 to the atmosphere through the trigger assembly 18. Now, there is no downward moving force to the main valve 7 so that the valve 7 is upwardly moved to a driving mode position in the right half from the axis x. Then, the pressurized air is fed to the upper surface of the piston 5, as indicated by the arrow 9, to strongly press down the piston 5. Thus, the driver 6 extends into the nose 10 to drive or strike the fastener into the object. When the trigger valve pin 19 is released to return to its static mode or home position, the main valve 7 is returned to the static mode position as shown in the left half from the axis x. No pressurized air is supplied to the upper surface of the piston 5. Further, the cylinder chamber above the piston 5 is communicated with an exhaust passage to the atmosphere. Additionally, the compressed air is fed from the return-air-chamber 11 to the lower surface of the piston 5 to cause the piston to rise abruptly from its lower dead point to the upper dead point or home position in the cylinder 4 as shown in FIG. 1.

In general, upon a driving operation, the piston strikes the bumper to be almost collapsed and then the collapsed bumper reacts to move the piston upward. On the other hand, high-pressure air is retained on the upper surface of the piston. Thus, the piston is forced to be pressed down again, resulting in downwardly moving the driver. This is so-called double-driving. The double-driving is undesirable. At the first driving, the driver properly strikes a fastener such as a nail to be driven into an object. At the second driving in the double-driving, the driver hits not only the fastener but the object such as a decorative panel to damage the hit area of the object. In this respect, the present invention aims to prevent the above double-driving. In a nose portion or housing portion closing the lower end of the cylinder 4, which is a flange 23 at the upper portion of the nose 10 in the illustrated embodiment, an annular recess 24 is formed to receive the ring bumper 16. The recess 24 has a sufficient depth to move a lower portion of the bumper 16 in a direction of the vertical axis x. The annular recess 24 may be formed in a lower extending portion of the housing instead of the flange 23 of the nose as possible as the recess receives the lower portion of the bumper 16 movably in a vertical direction.

Figure 2:
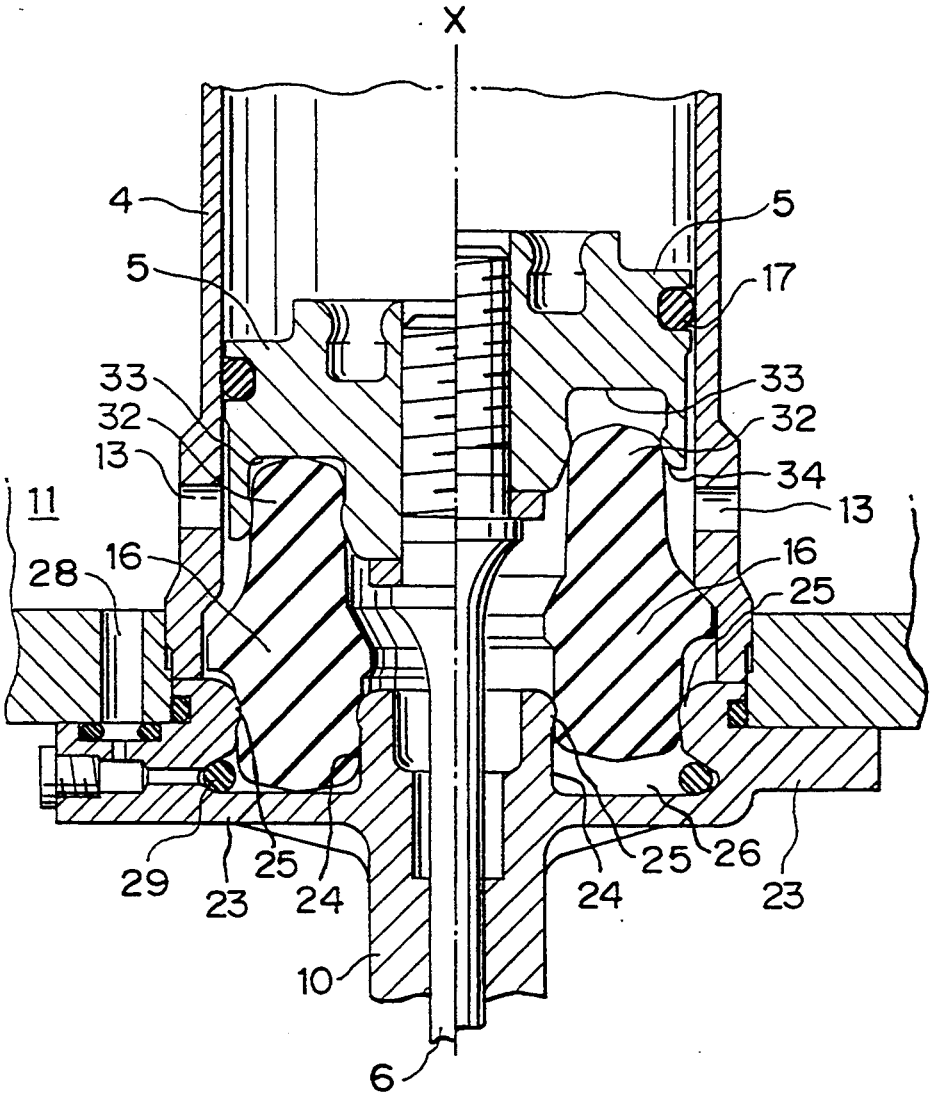
FIG. 2 is a sectional view of a lower portion of a piston-cylinder assembly, in which at left half of a cylinder from the axis x, a piston is positioned in a lower dead point and at right half of the cylinder from the axis x, the piston is immediately before the lower dead point.

Referring to FIG. 2, an inlet portion 25 of the annular recess 24 is made narrower than the lower portion of the bumper 16 so as to form an air chamber 26 closed by the lower end of the bumper which is tightly fitted in the inlet portion. The air chamber 26 in the annular recess 24 is supplied with pressurized air from the return-air-chamber 11 as a supply of pressurized air through a path 28 and an O-ring 29 as a check valve. In place of the pressurized air of the return-air-chamber 11, the pressurized air in a reservoir of the housing 2 may be supplied. A better result has been obtained from use of pressurized air of the housing 2 as the pressure of air is at a constant level and less subject to fluctuation.

Figure 3:
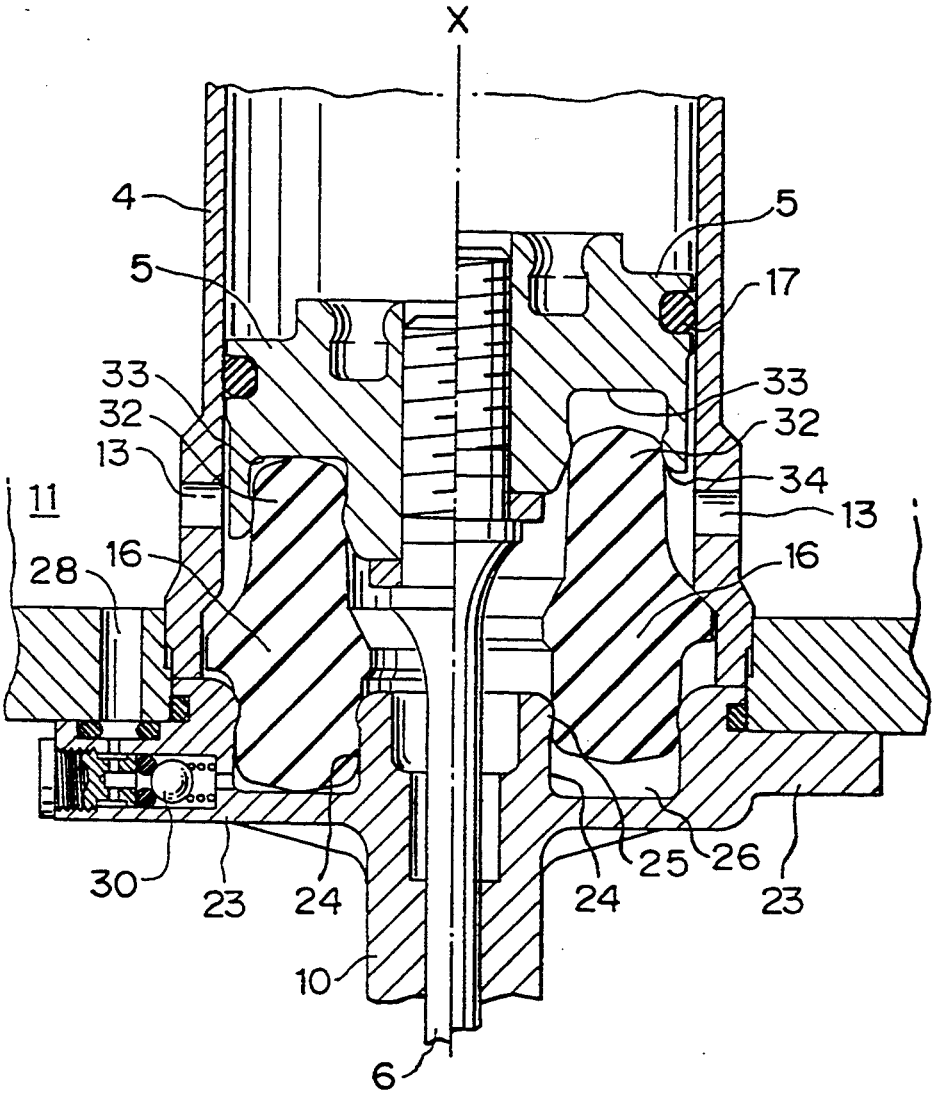
FIG. 3 is a similar view to FIG. 2 showing an alternative of a check valve.

As shown in FIG. 3, the O-ring 29 as the check valve may be substituted with a ball valve assembly 30. The ball valve assembly is positioned at the outlet of the path 28 so that the valve member can be replaced easily. Another check valve is acceptable as long as it can prevent pressurized air from flowing reversely to a normal direction from the pressurized air source to the air chamber 26.

Referring again to FIGS. 2 and 3, as shown in the right half from the axis x, the lower portion of the bumper 16 normally fits in the inlet portion 25 of the annular recess 24 to form the air chamber 26 closed by the lower end of the bumper. Pressurized air is supplied to the air chamber 26 via the check valve 29 or 30. In the driving mode, the pressurized air is fed onto the upper surface of the piston to strongly move the piston 5 down to drive a fastener such as a nail by means of the driver 6. The strong down-movement of the pistons forces the bumper 16 to go down as shown in left half from the axis x in FIGS. 2 and 3 so that the pressurized air is further compressed in the air chamber 26. Thus, the air pressure rises to a very high level in the air chamber 26. At the same time, the piston strikes the bumper to be almost collapsed. Then, the collapsed bumper reacts to move the piston upward. On the other hand, in response to the very high pressure in the air chamber 26, the bumper 16 has already been returned to the position as shown in right half from the axis x in FIGS. 2 and 3 although the air pressure on the upper surface of the piston tend to press down the piston again. As the pressure in the air chamber 26 is substantially identical with that of on the upper surface of the piston 5, the pressure in the air chamber 26 can sufficiently resist the force that the piston 5 pushes down the bumper 16 which is at the position as shown in right half from the axis x in FIGS. 2 and 3. Thus, down-movement of the piston 5 is suppressed to avoid the double-driving. Additionally, the air at very high pressure is stored in the air chamber 26 of the annular recess 24 in which the bumper 16 is vertically movably received, so that the bumper 16 is immediately returned to its upward or home position not only to help returning of the piston 5 but also to increase shock absorbing force of the bumper 16. Moreover, even if there is a little leak of pressurized air from the air chamber 26, pressurized air is replenished via the check valve to prevent the pressure of the air chamber from lowering. Thus, the shock absorbing force is greatly increased so that vibration and driving noise of the tool are greatly reduced. Heat generation from the bumper is also effectively suppressed, and the piston is very smoothly returned from the lower dead point to the upper dead point.

Further, according to the present invention, additional improvement is so made that shock absorbing force of the bumper does not decrease even when hard rubber having high strength is used to enhance the durability of the bumper. For this purpose, an upper portion of the bumper 16 is formed as an annularly projecting upper portion 32 which projects annularly toward the lower surface of the piston 5. In order to receive the projecting upper portion 32 of the bumper 16, a second annular recess 33 is formed on on the lower surface of the piston 5 which comes into contact with the bumper. The second annular recess 33 has an inlet portion 34 which is narrower than the inner portion (upper side in FIGS. 2 and 3) and a size that the projecting upper portion 32 of the bumper 16 is tightly received to fit in the recess. Upon downward movement of the piston 5, as shown in right half from the axis x in FIG. 2, the inlet 34 of the second annular recess 33 of the piston 5 is engaged with the projecting upper portion 32 of the bumper 16 to confine air in the recess 33. The strong downward movement of the piston 5 is continued to receive the projecting upper portion 32 in the recess 33, as shown in left half from the axis x in FIG. 2, so that the projecting upper portion 32 of the bumper 16 strongly compresses the air as confined in the second annular recess 33. Accordingly, the impact or shock by the abrupt down-movement of the piston 5 is substantially absorbed not only by the shock absorbing function according to the resilience of the bumper 16 but also by the function according to the compressed air in the second annular recess 33 into which the projecting portion 32 of the bumper 16 is fittingly received. Thus, even when a bumper would be made of hard rubber having a high strength but a low shock absorbing force by itself, higher shock-absorbing force is obtained. Thus, the durability of the bumper is also improved in comparison with the bumper of soft rubber or other resilient material. Combination of the compressed air in the second annular recess 33 with the aforementioned effect produced by the air chamber 26 of the first annular recess 24, the shock absorbing force is remarkably increased so that vibrations and driving noise of the tool is greatly reduced. Heat generation from the bumper is also effectively suppressed, and the piston is very smoothly returned from the lower dead point to the upper dead point.

Figure 4:
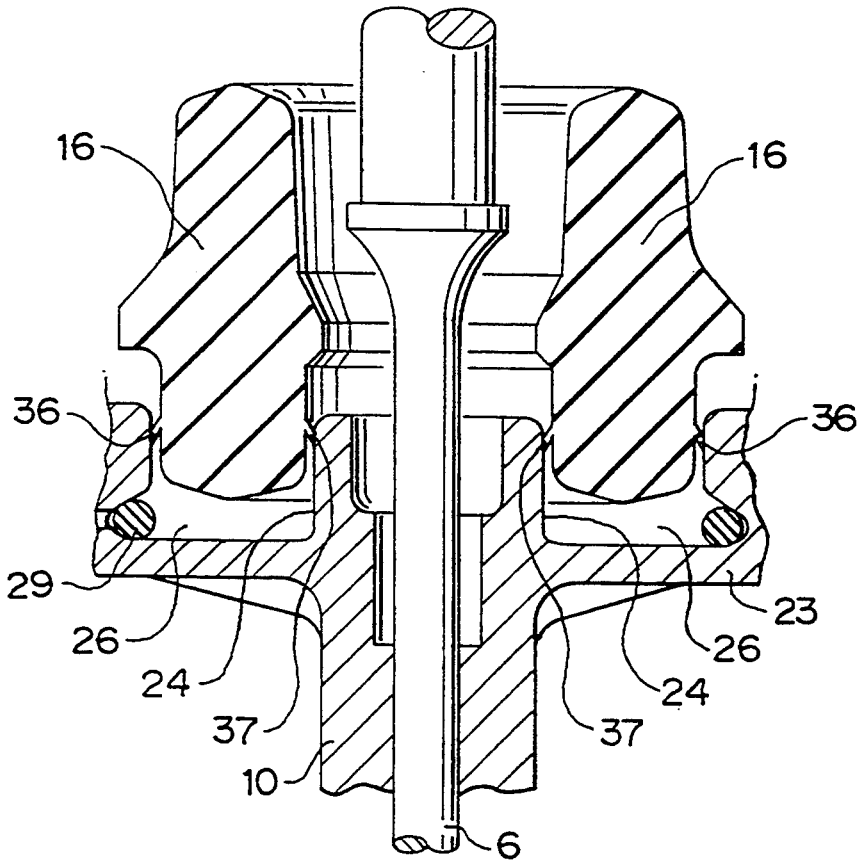
FIG. 4 is a sectional view showing an alternative of a bumper of a fastener driving tool.

FIG. 4 shows an alternative in which lip-like seals 36 and 37 are formed on the outer surface and the inner surface of a lower portion of the bumper 16, respectively. These seals 36 and 37 serve to maintain higher sealability of the air chamber 26. Instead of these lip-like seals, 0 rings may be placed between the bumper 16 and the annular recess 24 to maintain the sealability of the air chamber 26 at a still higher level.

The present invention may be embodied in other specific ways without departing from the spirit or essential characteristics thereof. The preferred embodiments described herein are therefore to be considered in all respects as illustrative and not restrictive, the scope of the invention being indicated by the appended claims rather than by the foregoing description. And all variations and modifications which come within equivalent of the claims are intended to be embraced therein.

What is claimed is:

1. A fastener driving tool comprising a housing for receiving pressurized air therein as a reservoir, a cylinder disposed within the housing, a piston reciprocatingly located within the cylinder, a driver connected with the piston to drive a fastener, a nose extending downward of the lower portion of the cylinder to locate a fastener to be driven, a return-air-chamber formed between the outer surface of the cylinder and the inner wall of the housing to store compressed air from the cylinder and to exhaust the compressed air to the lower surface of the piston in the cylinder and a ring bumper at the lower end of the cylinder to absorb shock of the moving piston; said tool further comprising:

(a) a first annular recess formed in a portion closing the lower end of the cylinder to receive the ring bumper with the recess having a sufficient depth to move a lower portion of the bumper downward and upward therein;

(b) said first annular recess formed so that the bumper is fittingly pressed into said recess to form an air chamber as defined in said recess closed by the lower end of the bumper; and (c) a check valve positioned between the air chamber and a supply of the pressurized air to feed the pressurized air to the air chamber so that the pressurized air is further compressed by the bumper which is downwardly moved by the abrupt downward movement of the piston.

2. The fastener driving tool of claim 1 wherein the first annular recess is formed on a nose portion closing the lower end of the cylinder.

3. The fastener driving tool of claim 1 wherein the first annular recess is formed on a housing portion closing the lower end of the cylinder.

4. The fastener driving tool of claim 1 wherein the pressurized air is fed from the housing to the air chamber.

5. The fastener driving tool of claim 1 wherein the pressurized air is fed from the return-air-chamber to the air chamber.

6. The fastener driving tool of claim 1 wherein said check valve is made of an O-ring disposed around the inner wall of one of the nose portion and the housing portion on which at least one air passing hole is formed.

7. The fastener driving tool of claim 1 wherein said check valve comprises a ball valve assembly located in a path between the recess and the supply of the pressurized air.

8. The fastener driving tool of claim 1 wherein lip-like seals are formed on the outer and inner surfaces of the bumper, respectively, to maintain high seal level in the air chamber.

9. The fastener driving tool of claim 1 wherein O-rings are placed on the inner and outer interfaces between the bumper and the annular recess to maintain the sealability of the air chamber at a high level.

10. The fastener driving tool of claim 1 further comprising:

(a) an annularly projecting upper portion formed on the bumper as projecting toward the lower surface of the piston; and (b) a second annular recess formed on the lower surface of the piston to receive said projecting upper portion of the bumper whereby said projecting upper portion of the bumper is fittingly pressed into said second recess to compress the air confined by the said second recess which is closed by the projecting upper portion of the bumper.

* * * * *